United States Patent [19]

Perlmutter

[11] 4,084,733

[45] Apr. 18, 1978

[54] GLOVE FORM

[76] Inventor: Frank Perlmutter, 1508 Beachcliff Dr., NE., Atlanta, Ga. 30329

[21] Appl. No.: 782,616

[22] Filed: Mar. 30, 1977

[51] Int. Cl.[2] ..... A41D 1/00

[52] U.S. Cl. ..... 223/78

[58] Field of Search ..... 223/78, 85, 87, 75, 223/76, 66, 61, 80

[56] References Cited

U.S. PATENT DOCUMENTS 3,486,670 12/1969 Sutton ..... 223/78

3,917,266 11/1975 Kiey ..... 223/78

*Primary Examiner*—Doris L. Troutman

*Attorney, Agent, or Firm*—Newton, Hopkins & Ormsby

[57] ABSTRACT

A form for drying and shaping golf gloves and the like consists of a vacuum formed unitary thin sheet plastic element which possesses springiness. The form is ribbed or scalloped longitudinally of its finger and palm portions to promote drainage and free circulation of drying air while allowing only minimal surface contact between the form and glove supported thereon. Extreme simplicity and economy of manufacturing are featured.

8 Claims, 4 Drawing Figures

GLOVE FORM

BACKGROUND OF THE INVENTION

Glove forms for drying and other purposes are known in the art and some examples of the prior patented art are found in U.S. Pat. Nos. 3,524,285; 2,783,925; 3,409,142 and 3,486,670.

In the known prior art devices of this general character, the forms tend to be restricted in their usage to gloves of one size or at least a very small range of sizes. Also, the prior art forms are not configured to impart a natural shape to the glove during the drying process and they tend to be rigid and excessively heavy and frequently expensive.

Therefore, the objective of this invention is to provide an improved glove drying and shaping form which is manufactured at minimal expense, is lightweight and unitary, and possesses the degree of resiliency as well as the configuration necessary to promote efficient drying while imparting a natural shape to the glove.

More particularly, the glove form of the invention is embodied in a unitary thin plastics material member which is preferably vacuum formed to a precise configuration. The form is springy for the purpose of supporting gloves of more than one size in a taut condition while they are drying. The very lightweight and very economical form is also ribbed at its finger and palm areas to promote drainage and to minimize total surface contact between the form and gloves mounted thereon. An absolute minimum of material is required to manufacture the plastic glove form and the general shell-like or concave nature of the form renders it most efficient for drying and shaping golf gloves which are soaked with perspiration.

Other features and advantages of the invention will become apparent during the course of the following description.

DETAILED DESCRIPTION

Figure 1:
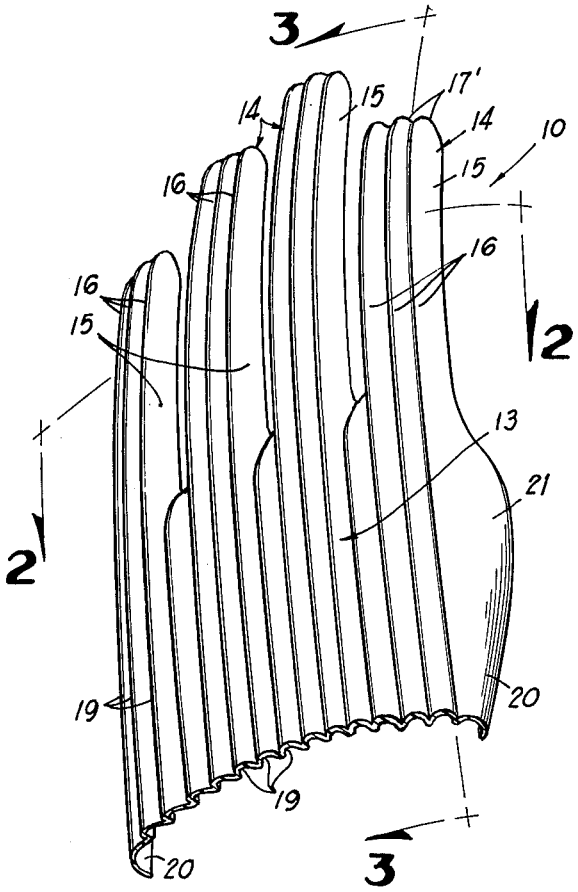
FIG. 1 is a partially broken away perspective view of a glove form embodying the invention.
Figure 3:
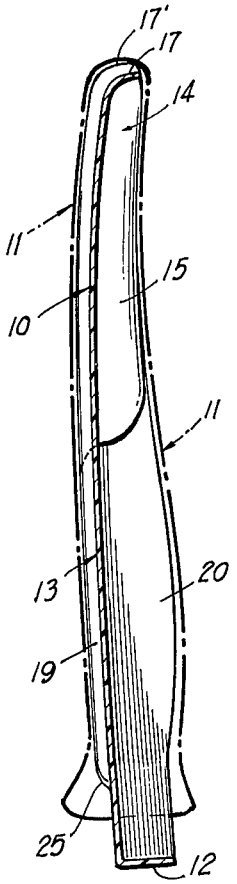
FIG. 3 is a longitudinal section taken on line 3—3 of FIG. 1.
Figure 2:
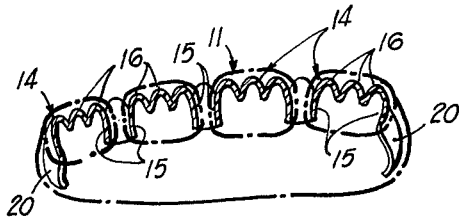
FIG. 2 is a transverse section through the form in the finger region taken substantially along line 2—2 of FIG. 1.

Referring to the drawings wherein like numerals designate like parts, and referring first to FIGS. 1 to 3, a glove form embodying the invention is designated in its entirety by the numeral 10 and is formed as a unit from a section of thin sheet thermoplastic material by vacuum forming. In this operation, the sheet material is heated in a vacuum forming machine and then drawn by vacuum against the molds or dies. Thereafter the sheet is cooled and the forms die cut from the sheet. The technique is well known in the art.

The unitary lightweight and inexpensive glove form thus produced is springy and can conform itself to gloves of different sizes. Usually one form will fit at least two size gloves. The form is also tough and durable and is shaped to impart to any glove thereon a natural shape during the glove drying process. FIGS. 2 and 3 in phantom lines show a golf glove 11 or the like applied to the form 10 and following the contours thereof. It can be noted that the glove form lacks a thumb section and the glove thumb merely hangs freely while on the form. The absence of a thumb portion on the form considerably reduces manufacturing costs and also allows gloves to be more easily fitted onto the form.

Continuing to refer to the drawings, the unitary sheet plastic form 10 is shell-like or concave and open at its side corresponding to the front of the hand and the wall of the form is placed in the article where the back of the natural hand would be located. As clearly shown in FIG. 3, the inner or wrist end of the glove form is closed by a transverse flat plate 12.

The form 10 is longer than the glove it receives and comprises a hand body portion 13 which, as stated, simulates the back of the natural hand from the wrist forwardly toward the fingers. It also includes separated discrete finger portions or extensions 14 corresponding to the four digits of the natural hand. Each finger extension 14 is roughly U-shaped in cross section and open toward the frontal side of the form. Each finger extension includes spaced curvilinear side walls 15 connected by an upper wall which includes preferably three parallel longitudinal transversely curved, spaced corrugations 16 or ribs which extend for the entire lengths of the finger extensions. The finger extensions 14 also have short front walls 17, FIG. 3, around which the corrugations 16 are extended as at 17' with a smoothly curved contour. As best shown in FIG. 3, the finger side walls 15 extend from the tips of the finger extensions to the body portion 13 and at this point the side walls 15 terminate and their edges 18 blend or fade into the wall of hand body portion 13. The side walls 15 and 20, FIG. 3, are gently curved longitudinally and vary in depth to impart a natural longitudinal curvature and overall thickness to the glove form.

The body portion 13 is somewhat arched transversely of the form and also has multiple longitudinal parallel preferably curved corrugations 19, some of which corrugations are continuations of or merge into the finger corrugations 16 and therefore extend for substantially the full length of the glove form. Other corrugations 19 in the hand body portion 13 terminate at the bases of the finger extensions as is clearly shown in FIG. 1. All corrugations or ridges 19 terminate inwardly of plate 12.

The body portion 13 has opposite side curvilinear walls 20 integral therewith and at the thumb side of the glove form the side wall 20 is forwardly enlarged to produce a rounded shoulder portion 21 at the point where the base of the natural thumb would normally be located. This shoulder blends gradually into the side wall 15 of the adjacent finger extension 14 corresponding to the natural index finger. As explained, the glove form does not include a full thumb extension.

During use, the glove 11 such as a wet golf glove is placed over the form 10 and the springiness of the form will facilitate the application of the glove to the form and following application will tend to hold the glove taut on the form and open so that air can circulate freely through the interior of the glove for drying it. The corrugations or ribs 16 and 19 serve several purposes. They enhance the resiliency of the finger extensions for the above-stated purposes of facilitating glove application to the form and expanding the finger passages to promote drying. Additionally, the corrugations form longitudinal drainage channels for any excess perspiration which may be inside of the glove. Most importantly, the curved corrugations minimize the total area of contact between the form and the glove, again to promote drying. Only the apex of each corrugation is in contact with the glove along a single line of contact. The several advantages of the form compared to the prior art should now be readily apparent.

Figure 4:
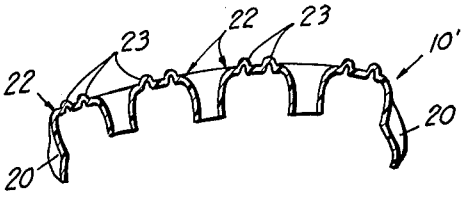
FIG. 4 is a sectional view, similar to FIG. 2, showing a modification.

FIG. 4 of the drawings shows a variant of the invention which differs from the prior embodiment only in the shape and arrangement of the corrugations or ribs. All other parts remain unchanged as to structure and function and therefore need not again be illustrated or described. The slightly modified glove form 10' in FIG. 4 has finger extensions 22 shown in cross section which are essentially like the previously described finger extensions 14. That is to say, they are roughly U-shaped in cross section. However, the corrugations or ribs 23 are formed upwardly from the roofs of the finger extensions and may be two or more in number for each finger, as shown. They extend longitudinally and, as in the prior embodiment, are continued across the hand body portion of the form, not shown in FIG. 4. The arrangement in FIG. 4 has the advantage of being somewhat easier to die cut and vacuum form and requires a lesser amount of material. Otherwise, the modified form is identical to the previous embodiment.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A glove form for drying and shaping gloves comprising a unitary formed thin sheet material form body having a substantial degree of resiliency at least in the transverse direction, said form body simulating the shape of a natural hand and including spaced finger extensions of generally U-shaped cross section and side walls rearwardly of the finger extensions, one side of the form body being open whereby the entire form body possesses a cavity, and the form body having a multiplicity of corrugations formed longitudinally therein and extending from the wrist end of the form body to the forward ends of said finger extensions.

2. A glove form as defined in claim 1, and said finger extensions having side wall portions extending from the forward tips of the finger extensions to points near the longitudinal center of the form body where the side wall portions are joined with a top wall of the form body simulating the back of a natural hand.

3. A glove form as defined in claim 2, and said top wall of the form body having some of said longitudinal corrugations which are extensions of corrugations in the finger extensions and also having additional longitudinal corrugations which terminate at the bases of the finger extensions, whereby said top wall is continuously corrugated across substantially the entire width of the form body.

4. A glove form as defined in claim 2, and said finger extensions further having leading end walls joined with said side wall portions whereby the entire margin of the form body is continuously skirted and the form body is of shell-like formation and open at its rear end.

5. A glove form as defined in claim 1, wherein said sheet material is moldable plastics material and said form body is vacuum formed.

6. A glove form as defined in claim 1, and said longitudinal corrugations are transversely arched and are approximately of equal size throughout the length of the form body.

7. A glove form as defined in claim 1, and the form body being somewhat arched transversely and said side walls being configured to simulate the varying thickness of a natural hand throughout its length.

8. A glove form as defined in claim 2, and said corrugations projecting above the top wall portions of said finger extensions.

* * * * *